US011731824B2

(12) United States Patent
Cotte et al.

(10) Patent No.: US 11,731,824 B2
(45) Date of Patent: Aug. 22, 2023

(54) PACKAGE COMPRISING MEANS FOR RETAINING AN OBJECT

(71) Applicant: PA. COTTE SA, Pully (CH)

(72) Inventors: Pierre-Alain Cotte, Amberg (DE); Denis Mourrain, Vertou (FR); Pierre Blot, Nantes (FR); Ronan Affre De Saint Rome, Oudon (FR)

(73) Assignee: PA. COTTE SA, Pully (CH)

( * ) Notice: Subject to any disclaimer, the term of this patent is extended or adjusted under 35 U.S.C. 154(b) by 267 days.

(21) Appl. No.: 17/295,348

(22) PCT Filed: Nov. 15, 2019

(86) PCT No.: PCT/EP2019/081558

§ 371 (c)(1),
(2) Date: May 19, 2021

(87) PCT Pub. No.: WO2020/104339

PCT Pub. Date: May 28, 2020

(65) Prior Publication Data

US 2022/0002061 A1 Jan. 6, 2022

(30) Foreign Application Priority Data

Nov. 23, 2018 (FR) ..... 1871780

(51) Int. Cl.
*B65D 81/07* (2006.01)
*B65D 5/24* (2006.01)
(Continued)

(52) U.S. Cl.
CPC ..... *B65D 81/07* (2013.01); *B65D 5/241* (2013.01); *B65D 5/5028* (2013.01); *B65D 25/102* (2013.01); *B65D 2581/051* (2013.01)

(58) Field of Classification Search
CPC .... B65D 5/241; B65D 5/5028; B65D 25/102; B65D 81/07; B65D 2581/051
(Continued)

(56) References Cited

U.S. PATENT DOCUMENTS 4,903,827 A * 2/1990 Phelps ..... B65D 81/075 206/583
6,976,586 B2 * 12/2005 Halpin ..... B65D 81/07 206/583
(Continued)

FOREIGN PATENT DOCUMENTS

WO 2017/083115 5/2017

OTHER PUBLICATIONS

International Preliminary Report on Patentability issued by the International Searching Authority, dated May 25, 2021, for International Patent Application No. PCT/EP2019/081558; 7 pages.
(Continued)

*Primary Examiner* — Luan K Bui
(74) *Attorney, Agent, or Firm* — Faegre Drinker Biddle & Reath LLP

(57) ABSTRACT

A package including:
a case having a bottom and a peripheral rim which can adopt:
a stowing position in which the peripheral rim extends substantially parallel to the bottom;
a use position in which the peripheral rim extends from the bottom;
a cover; and
holding means for maintaining in the case an object to be transported. The holding means includes:
a first part secured to the case; and
a second part secured to the cover. At least one of the first part and the second part is relaxed in the stowing position of the peripheral rim, and tensioned in the use position of the peripheral rim.

20 Claims, 9 Drawing Sheets

(51) Int. Cl.
*B65D 5/50* (2006.01)
*B65D 25/10* (2006.01)

(58) Field of Classification Search
USPC ..... 206/45.28, 45.29, 583, 736, 751, 752, 206/754, 774
See application file for complete search history.

(56) References Cited

U.S. PATENT DOCUMENTS

| | | | | |
|---|---|---|---|---|
| 7,658,281 | B2 * | 2/2010 | Eichenberger | B65D 81/07 206/583 |
| 8,061,522 | B2 * | 11/2011 | Eskenazi | B65D 81/05 206/594 |
| 8,387,856 | B1 * | 3/2013 | Lachance | B65D 5/6655 206/757 |
| 8,794,435 | B1 | 8/2014 | Marini | |
| 2003/0209463 | A1 * | 11/2003 | Halpin | B65D 81/07 206/583 |
| 2008/0110788 | A1 | 5/2008 | Keiger | |

OTHER PUBLICATIONS

International Search Report and Written Opinion issued by the International Searching Authority, dated Dec. 16, 2019, for International Patent Application No. PCT/EP2019/081558; 13 pages.

* cited by examiner

PACKAGE COMPRISING MEANS FOR RETAINING AN OBJECT

CROSS-REFERENCE TO RELATED APPLICATIONS

The present application is a national stage entry of International (PCT) Patent Application Number PCT/EP2019/081558, filed Nov. 15, 2019, which claims priority to French Patent Application No. 1871780, filed Nov. 23, 2018, the subject matter of each is expressly incorporated herein by reference.

The field of the invention is that of logistics.

More specifically, the invention relates to a package, or a logistic packaging means, that is to say a container, for conveying objects between two destinations, by means of a package.

To transport an object in complete safety, and in a secure manner, packages such as boxes or cartons are known.

In general, packages comprise a case having a bottom and a peripheral rim which together define an internal volume in which the object to be transported is housed.

The packages also comprise a cover which is movable relative to the case. These covers can in particular adopt a closed position in which the cover closes the internal volume of the case.

In order to allow the protection of the objects transported, some packages comprise holding means to maintain the object to be transported in the case.

Holding means which are in the form of a foam panels integrated into the case and the cover are known. The foam panels can be attached to the case if required. In other words, the foam panels can be integrated into the case only if their presence is required.

More specifically, the foam panels are secured to the bottom of the case, optionally to its peripheral rim, and to the cover.

The object to be transported is then inserted into the internal volume so as to contact the foam and to be blocked at least by the foam of the bottom and the foam of the cover.

This type of holding means has the major disadvantage of its thickness, or, in other words, the space it occupies in the internal volume of the case.

Indeed, the foam takes up a major part of the internal volume of the case. However, the foam has elastic features so as to form deformable holding means to conform to the contour of the object to be transported.

However, depending on the size of the object, several packages should be provided.

For example, for a large object and for a small object, the same case cannot be used. In the case of the small object, if a case or package suitable for a large object is used, the foam is not deformed suitably on contact with the small object, and the latter may then displace in the internal volume of the case at the risk of being damaged.

On the contrary, if a large object is introduced into the internal volume of a case intended to contain a small object, the package may become unusable for lack of insufficient space in the internal volume, the cover therefore not being able to be closed properly so as to actually block the internal volume of the case. As a result, the object is not really protected and is visible to anyone carrying the package, which can lead to a risk of theft of the object.

Transporters or packaging professionals must consequently have packages of different sizes depending on the size of the objects to be transported.

Moreover, the presence of the foam makes the package bulky when not in use, even if the package is foldable to bring it into a stowing configuration or "flat" storage.

Indeed, folding the package allows to optimize its space requirement when not in use. However, the compression of the foam when folding the device can affect the effectiveness of the foam in protecting the object to be transported. When the foam is compressed, it loses elasticity, and may not expand properly upon decompression; this is particularly true as the duration of compression of the foam is significant.

To avoid this loss of elasticity, it is therefore necessary to avoid excessive compression of the foam, which only allows a partial reduction in the space requirement of the package when it is not in use.

Transporters or packaging professionals must, consequently, benefit from a large room allowing the storage of packages either in their use configuration, or partially folded, or separated, that is to say that the foam is separated from the case for the different package sizes. This then represents a significant storage cost which is generally charged to the final consumer.

According to another known technique, the holding means are in the shape of a plastic envelope inside which the object to be transported is slipped, the envelope is then deformed so that its walls contact the object to be transported and keep it in its position.

According to a first type, the envelopes can be secured to the bottom of the case and their deformation can be carried out for example by heating so as to retract the material, generally a plastic material, so that the latter stiffens upon contact with the object.

A disadvantage of this solution lies in the fact that the deformation of the envelope, when it is carried out by heating, cannot be carried out by everyone since this technique involves the use of specific heating equipment.

Indeed, heating means, such as heaters for example, must be used and may require special training so that only professionals can deform the envelope.

Moreover, when the envelope is secured to the bottom of the case, this may have a major disadvantage to the integrity of the case, especially if the latter is made of cardboard, too high heat being able to destroy the cardboard by burning it.

In addition, inserting the object to be transported into the envelope can be difficult, if not impossible.

This is particularly verified if the object to be transported is inserted into the envelope once the case is in shape, that is to say the internal volume is defined, the peripheral rim of the case having in particular a major obstacle when the object is inserted into the envelope.

To overcome this, it may be necessary to first insert the object into the envelope then to form the case and finally to deform the envelope.

This represents a significant handling time which can be detrimental for professionals and also be impossible to be performed for individuals, in particular to deform the envelope or shape the case.

According to a second type, the envelope can also be secured to a plate intended to be housed in the case. In this case, the object is introduced inside the envelope then, in order to secure and maintain the object, the envelope is deformed by folding the edges of the plate, so as to stretch the two walls of the envelope to trap the object. Once this is complete, the folded plate can be inserted into the case and then the movable cover can be closed on the case.

These holding means also have some disadvantages.

Indeed, the insertion of the object in the envelope does not pose a problem, however the deformation of the plate, in particular the folding of its edges represents a complicated manipulation, even impossible to achieve when the object is large and the envelope to be deformed offers high resistance to deformation. The deformation of the envelope can then become time-consuming and put off professionals who will then do a partial deformation or else propose a larger package, resulting in a higher transport cost for the final consumer.

Furthermore, this requires the storage of both the case, the cover and the holding means, which represents a detrimental space requirement and therefore an additional cost which is often passed on to the final customer.

The purpose of the invention is in particular to overcome the disadvantages of the prior art.

More specifically, the purpose of the invention is to provide a package provided with easy-to-use holding means and allowing the transport of an object in complete safety.

An object of the invention is furthermore to provide such a package which, when not in use, has a reduced space requirement so as to limit the storage space for several packages.

Furthermore, the object of the invention is to provide such a package suitable for both transporting large objects and very small objects, in complete safety.

These purposes, as well as others which will appear later, are achieved thanks to the invention which relates to a package comprising:

a case having a bottom and a peripheral rim which can adopt:

a stowing position in which the peripheral rim extends substantially parallel to the bottom;

a use position in which the peripheral rim extends from the bottom;

a cover movable relative to the case and able to adopt:

a closed position in which the cover covers the peripheral rim;

an open position, in which the cover is removed from the peripheral rim, holding means for maintaining in the case an object to be transported, inserted into the case, characterized in that the case comprises means for blocking the peripheral rim in its use position, in that the holding means are deformable and comprise:

a first part secured to the case;

a second part secured to the cover, and in that at least one of the first part and the second part is relaxed in the stowing position of the peripheral rim, and tensioned in the use position of the peripheral rim.

The tensioning of one of the first part and of the second part of the holding means is thus controlled by placing the peripheral rim in the use position. Thus, when the package is not in use, the holding means are relaxed, which promotes their lifespan. Indeed, a continuous tensioning of the holding means can adversely affect their capacity for deformation, in particular as regards their elasticity which will become weaker as the tension is maintained. This also allows to reduce the space requirement of the package when not in use, as discussed below.

Advantageously, the peripheral rim comprises a front panel;

a rear panel;

two side panels connecting the front panel and the rear panel, each panel being articulated to the bottom, the panels being substantially perpendicular to the bottom in the use position of the peripheral edge.

Thus, when the package is not in use, it can be folded for storage. When folded, the package occupies a small space allowing transport professionals in particular to store several packages in a small space. When an object has to be transported, it is then sufficient to shape the package by positioning the edge in the use position, that is to say by positioning the panels of the peripheral edge substantially perpendicular to the bottom of the case.

Each side panel is advantageously connected to the front panel and to the rear panel by junction means, the displacement of the side panels when switching the peripheral edge from its stowing position to its use position, causing the displacement of the front panel and the rear panel.

In this case, the blocking means allow stably maintaining the peripheral edge in the use position. In other words, when the peripheral edge is in its use position, a voluntary action is necessary to position it in its stowing position.

The shaping of the case, in particular the transition of the peripheral rim between its stowing position and its use position and the placement of the object to be transported is then facilitated.

Indeed, the positioning of the side panels perpendicular to the bottom of the case causes the automatic positioning of the front panel and the rear panel also perpendicular to the bottom of the case. Moreover, the blocking means allow to prevent the peripheral rim from adopting its stowing position unexpectedly. The blocking means indeed act against the holding means which tend to attract the panels of the peripheral rim towards the bottom of the case, that is to say to position the peripheral rim in its stowing position.

Thus, by a simple pulling movement on the side panels towards the outside of the case, it is possible to shape the case to allow its use. This is significantly faster than a conventional case in which each panel of the peripheral rim is positioned perpendicularly to the bottom of the case independently of the other panels, without any device for blocking the panels in the use position. Preferably, the means for blocking the peripheral rim in its use position belong to the following group:

by magnetism;

by insert;

by deformation;

by bracing.

Such blocking means are simple to implement and ensure that the peripheral rim is maintained in its use position. Indeed, these blocking means do not require the use of dedicated tools or a particular technique. In other words, these assembly means can be used by anyone shaping the case, without special skills.

Advantageously, at least one of the first part and the second part of the holding means has at least one elastically deformable portion.

This allows the holding means to adapt to the shape of the object to be transported. Furthermore, the elastically deformable portion allows the holding means to exert a force on the object to be transported to maintain it in the internal volume between the two parts of the holding means.

According to an advantageous aspect, at least one of the first part and the second part of the holding means has an adherent coating.

According to another advantageous aspect, at least one of the first part and the second part of the holding means has a sliding coating, the adherent coating being located between two portions of the sliding coating.

The adherent coating, which is primarily in contact with the object to be transported, and the sliding coating, which is in contact with a peripheral part of the object to be transported and generates the tension force of the holding means, allow the adaptation of the holding means to the contours of the object to be transported. Indeed, the sliding coating prevents the holding means from fully adhering to the object to be transported so that the adherent coating is positioned substantially in the center of the internal volume of the case when it is in contact with the object to be transported.

Furthermore, the combination of the adherent coating, the sliding coating and the elastically deformable portion allows to significantly reduce the force applied by the holding means on the object to be transported to maintain it in the internal volume. Indeed, the force applied to the object to be transported is the product of the elastic force of the elastically deformable means and the coefficient of friction of the adherent coating.

According to Coulomb's law, for equal force applied to the object, the greater the coefficient of friction, the lower the elastic force required.

Consequently, the presence of the adherent coating allows to reduce the force applied by the holding means on the object to be transported, and therefore the elastic force of the holding means. The force required to close the cover is therefore lower.

Preferably, the adherent is centered relative to the bottom of the case in the closed position of the cover.

This contributes to the good retention of the object to be transported in the internal volume and to the transport comfort of the package since the mass of the object to be transported is globally distributed in the package.

According to an advantageous embodiment, the first part and the second part of the holding means are distinct from each other, and in that:

- the first part is spaced from the bottom of the case in the use position of the peripheral edge;
- the second part is in the form of a foam secured to a lower face of the cover turned towards the bottom of the case in the closed position of the cover.

The object to be transported is thus maintained between the two parts of the holding means.

In addition, the use of foam allows to offer a soft contact, that is to say without having any risk of damage to the object to be transported.

Furthermore, the spacing between the bottom and the first part of the holding means promotes the deformation of the first part of the holding means which does not damage against the bottom of the case by friction, for example.

According to another advantageous embodiment:

- the cover comprises a plate and a jamb extending in the direction of the bottom and having a free end in the vicinity of the bottom of the case in the closed position of the cover;
- the first part of the holding means is formed by the bottom of the case;
- the second part of the holding means is flexible and is secured to the bottom of the case or to the peripheral edge in the vicinity of the bottom of the case by a first end, and to the free end of the jamb by a second end, the first end and the second end of the holding means being distant from each other and delimiting therebetween, on the bottom, an area for receiving the object to be transported in the closed position of the cover.

The securing of the second part of the holding means to the bottom of the case on the one hand, and to the jamb of the cover on the other hand, allows that simply placing the cover in the closed position ensures the holding of the object in the case.

More specifically, the object is maintained in the case by being wedged between the bottom of the case and the holding means which then cover the object.

Moreover, when the cover is in its closed position, the free end of the jamb in the vicinity of the bottom allows to position the second end of the second part of the holding means also in the vicinity of the bottom, and more particularly resting on the bottom when the free end of the jamb is separated from the bottom of the case only by the thickness of the second part of the holding means. Thus, this allows to press the object to be maintained against the bottom of the case to ensure its retention.

Advantageously, the holding means comprise at least one strap.

The use of one or more straps allows to give the holding means a particularly useful limit to deformation, in particular to ensure the blocking of the object to be transported against the bottom of the case. Thus, even in the event of impacts, the object to be transported remains pressed against the bottom of the case and has a low risk of damage by abutting against the peripheral rim or the cover, for example.

In this case, the or each strap has an inner face turned towards the bottom of the case, the inner face having an adherent coating.

The adherent coating allows good adhesion of the strap of the holding means with the object to be transported. This further promotes maintaining the object to be transported in position by the holding means. The adherent coating may in particular be provided with spikes or protrusions forming attachment means.

Advantageously, the or each strap has an X or Y shape, a first portion of the X or of the Y having the first end of the holding means and an opposite second portion having the second end of the holding means.

Such a shape of the or each strap allows to cover a large part of the bottom of the case while ensuring increased central support.

Moreover, such shapes allow adaptation of the holding means to an object to be transported having an irregular shape for example. Indeed, an object to be transported having projecting parts could be subjected to significant stresses which could weaken it or even damage it. Thanks to the X or Y shape, only a portion of the or each strap can be in contact with the object to be transported to maintain it in position, leaving free the other parts of the object to be transported, in particular the projecting parts, so as not to subject it to constraints.

Alternatively, the holding means comprise a film intended to at least partially cover the bottom of the case in the closed position of the cover.

Such a film allows to best match the contours of the object to be transported. This is particularly useful for objects to be transported which have a substantially planar shape.

Preferably, the holding means are elastic at least at their first end and at their second end.

Such elasticity allows the deformation of the holding means, in particular so that they adapt to the shape of the object to be transported.

According to an advantageous aspect, the jamb is pivotally mounted on the plate.

This pivoting further reduces the space requirement of the device when not in use. Indeed, the jamb can then be folded back against the plate, which allows to limit the thickness of the cover when it is folded to cover the case.

Advantageously, the bottom of the case has a cavity forming a housing for receiving the object to be transported.

The cavity is particularly advantageous for housing therein a small object to be transported, and in particular of small thickness, for example a coin. Thus, the coin is confined in the cavity so that it cannot displace over the entire surface of the bottom of the case. Then, this contributes to the safety of the object to be transported, and in particular to the preservation of its integrity. Advantageously, the cavity has a base having an adherent surface intended to cooperate with the object to be transported in order to maintain it in position.

The displacements of the object to be transported are then still limited, for the benefit of preserving its integrity.

According to an advantageous embodiment, the cavity is centered on the bottom of the case.

Therefore, it is also possible to use the cavity as a positioning index for the object to be transported when the latter is of large size. Furthermore, the centered cavity provides a centering element for the object to be transported relative to the holding means.

Moreover, this allows the retaining forces generated by the holding means to be distributed more evenly when the object to be transported is bulky and/or angular at its edges.

Preferably, the case comprises means for locking the cover in its closed position, the locking means including a first part secured to the case and a second part secured to the cover.

Such locking means allow to ensure the protection of the object to be transported in the internal volume of the case, in particular against theft.

Advantageously, the case carries an electronic dialogue interface.

This electronic dialogue interface can, for example, allow a user to learn about information such as whether or not the package is locked, its destination or its origin. This is particularly true when the electronic dialogue interface is equipped with a screen.

Other features and advantages of the invention will emerge more clearly upon reading the following description of various preferred embodiments of the invention, given as illustrative and non-limiting examples, and the appended drawings, among which:

FIG. 1 is a perspective top view of a package according to the invention comprising holding means for maintaining an object to be transported, according to a first embodiment;

FIG. 2*a* is a detail view of the holding means showing several faces and in particular a face provided with adherent means;

FIG. 2*b* is a schematic view of a variant embodiment of the holding means according to the first embodiment;

Figure 1:
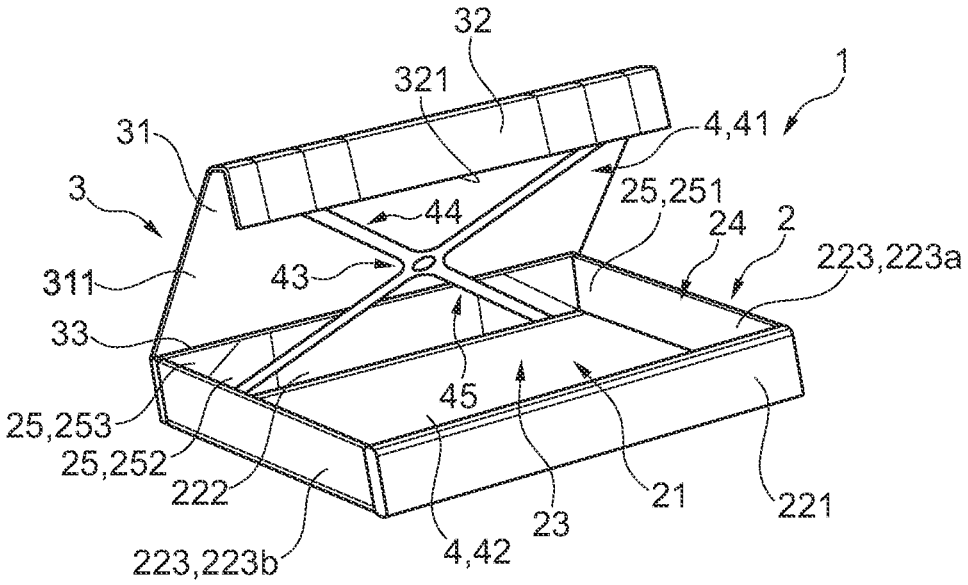

With reference to FIG. 1, a package 1 according to the invention is shown.

The package 1 comprises:

a case 2;

a cover 3;

holding means 4, a detail of which is illustrated in FIG. 2.

Preferably, the case 2 and the cover 3 are made of a robust material, having in particular features of resistance to deformation and to impact, for example of a material such as metal, resistant plastic or a composite material (that is to say a material formed from several different materials). For example, a composite material that can be used comprises a fabric reinforcement as well as a plastic resin.

The package 1 is thus reusable and resistant to the use hazards, in particular to the shocks to which it is subjected. This allows to limit its impact on the environment, particularly with regard to waste.

Indeed, once the object to be transported 5 is conveyed, the package 1 can be reused for sending another object or returned to a transporter who will reuse it. Thus, the costs and pollution associated with recycling the package are limited at the end of the package's life, that is to say when package 1 is too damaged to allow the transport of an object in complete safety. In other words, conventional packaging made of cardboard is generally destroyed and recycled as soon as it is used up, while the package according to the invention will be used several times before being recycled.

Moreover, the use of resistant plastic, composite material or metallic material allows the package to withstand climatic conditions, in particular rain, which significantly damages the cardboard of packages conventionally used.

Figure 3:
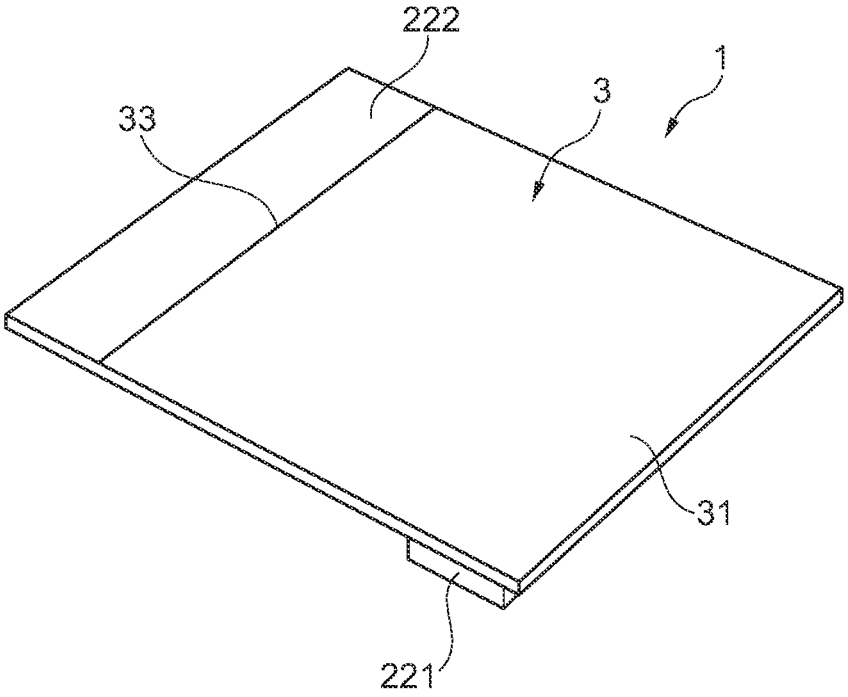
FIG. 3 is a perspective top view of the package according to the invention in a folded state or a storage state.

The case 2 is foldable and comprises a bottom 21 and a peripheral rim 22 extending from the bottom 21. The case 2 is foldable, that is to say that the peripheral rim 22 is movable relative to the bottom 21 and can adopt:

- a stowing position (corresponding to the storage position of the package 1 illustrated in FIG. 3) in which the peripheral rim 22 is substantially parallel to the bottom 21;
- a use position in which the peripheral rim 22 extends substantially perpendicularly to the bottom 21.

The bottom 21 and the peripheral rim 22 together define an internal volume 23 of the case 2.

The peripheral rim 22 has a parallelepiped shape which defines an opening 24 for access to the internal volume 23 of the case 2.

Figure 7:
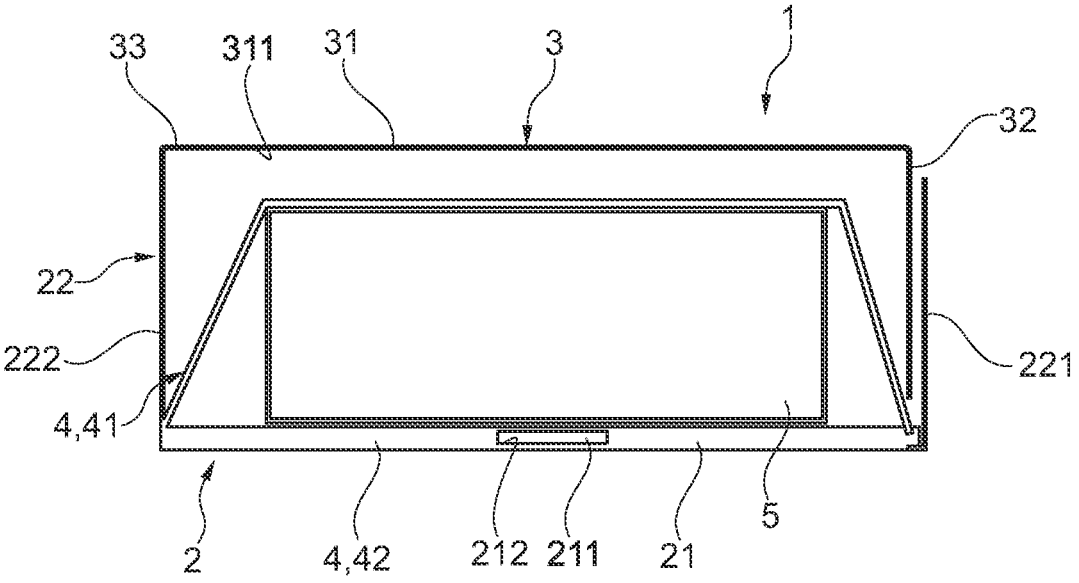
FIG. 7 is a longitudinal sectional view of the package according to the invention into which an object to be transported is inserted and the holding means are shaped to allow the means of the object to be transported.
Figure 8:
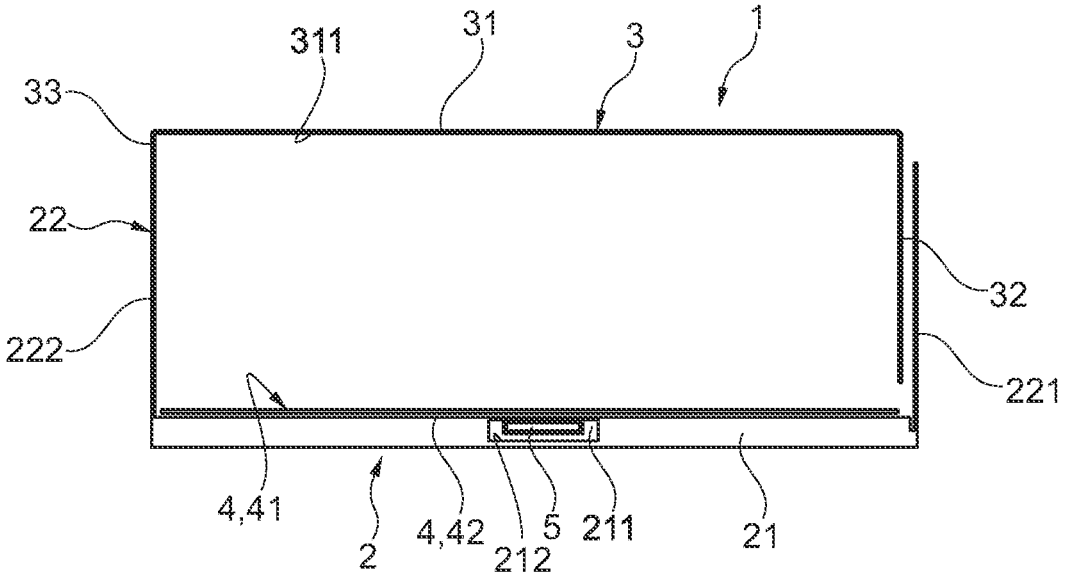
FIG. 8 is a longitudinal sectional view of a package according to the invention inside which is housed a small object to be transported, the holding means being shaped to maintain the small object in position.

As shown in FIGS. 1, 7 and 8 in particular, the bottom 21 has a cavity 211 intended to receive an object to be transported 5, in particular when the latter is of small size, as illustrated in FIG. 8. The cavity 211 has a base 212 having an adherent surface.

Figure 4:
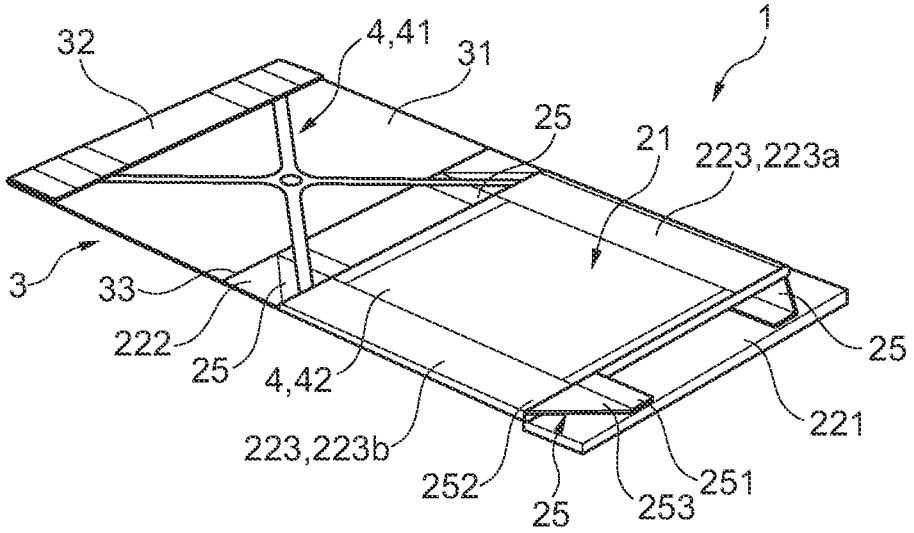
FIG. 4 is a perspective top view showing the package according to the invention in an unfolded state prior to its shaping.
Figure 5:
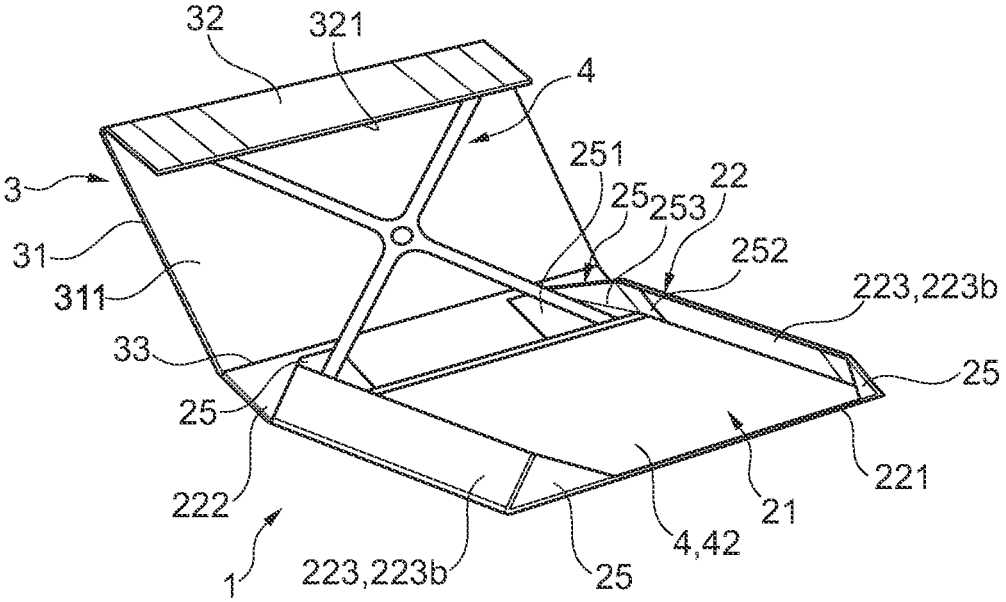
FIG. 5 is a perspective top view showing the shaping of the package according to the invention.

As illustrated in FIGS. 1, 4 and 5, the peripheral rim 22 comprises:

a front panel 221;

a rear panel 222;

two side panels 223.

More specifically, the peripheral rim 22 comprises a first side panel 223*a*, and a second side panel 223*b*.

The rear panel 222 and the front panel 221 are opposite to each other with respect to the bottom 21. Likewise, the first side panel 223*a* and the second side panel 223*b* are also opposite to each other with respect to the bottom 21 and each connect the front panel 221 and the rear panel 223.

Each of the front panel 221, the rear panel 222, and the side panels 223 are articulated to the bottom 21 of the case 2. In other words, the front panel 221, the rear panel 222 and the side panels 223 are pivotable relative to the bottom 21 to allow the peripheral rim 22 to adopt its use position or its stowing position.

With reference to FIGS. 12 to 16, the case 2 also comprises means 225 for blocking the peripheral rim 22 in its use position. The blocking means 225 belong to the following group:

by magnetism;

by insert;

by deformation;

by bracing, or interference.

Figure 13:
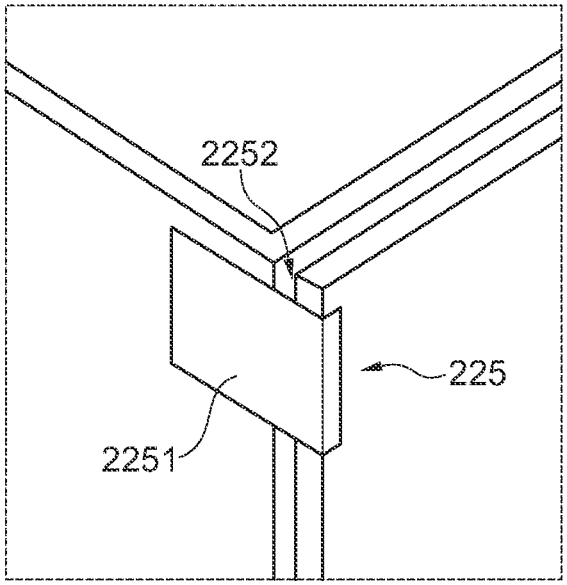
FIG. 13 is a perspective view of the means for blocking the case in a use position, according to a first embodiment.

FIG. 13 illustrates blocking means 225 by bracing or interference. More specifically, each side panel 223 comprises a hook 2251 protruding from the side panel 223. The hook 225 thus leaves a space 2252 with a rim of the side panel 223, this space 2252 being intended to receive the front panel 221 or the rear panel 222.

Each hook 2251 is elastically deformable so that, when the front panel 221 and the rear panel 222 are shaped, they elastically deform each hook 2251 to contact a rim of a side panel 223.

Each hook 2251 then recovers its initial shape so as to maintain the front panel 221 and the rear panel 222 against the rim of a side panel 223.

In a variant not shown, the blocking means 225 may take the shape of tabs secured to the front panel 221 and the rear panel 222. These tabs are intended to be housed in slots made in the side panels 223. The cooperation between the tabs and the slots is advantageously tightened so that when the tabs are inserted into the slots, it is necessary to exert a significant pulling force on the front panel 221 and the rear panel 222 to release the tabs from the slots.

Figure 14:
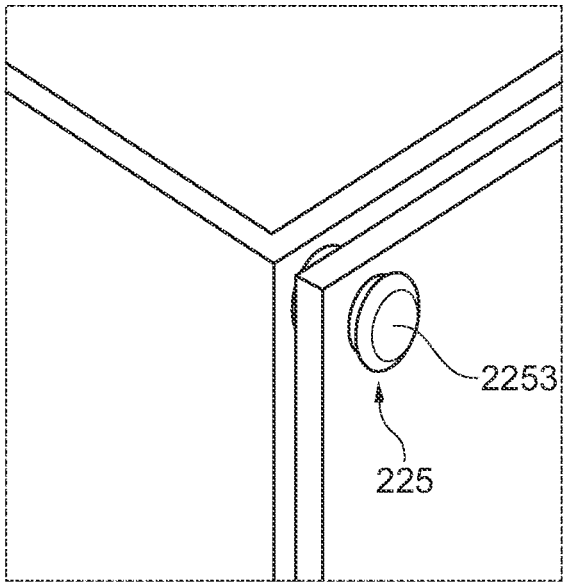
FIG. 14 is a perspective view of the means for blocking the case in a use position, according to a second embodiment.

FIG. 14 illustrates blocking means 225 by insert, that is to say by assembling two panels of the peripheral rim 22 using an insert 2253.

More specifically, an insert 2253 such as a pin or a stud is inserted into openings made on the side panel 223, the front panel 221 and the rear panel 222. In this case, the front panel 221 and the rear panel 222, or the side panels 223 have returns intended to overlap the side panels 223, or the front panel 221 and the rear panel 222 respectively. The returns then have the opening intended to receive the insert 2253.

Furthermore, the insert 2253 comprises a central portion intended to pass through the panel openings, and two foldable stops, each located on either side of the central portion. The shape blocking of the peripheral rim 22 is then done by inserting the central part of the inserts 2253 into the openings of the panels, then folding the foldable stops so that the panels of the peripheral rim are sandwiched between the two foldable stops of the insert 2253.

Figure 15:
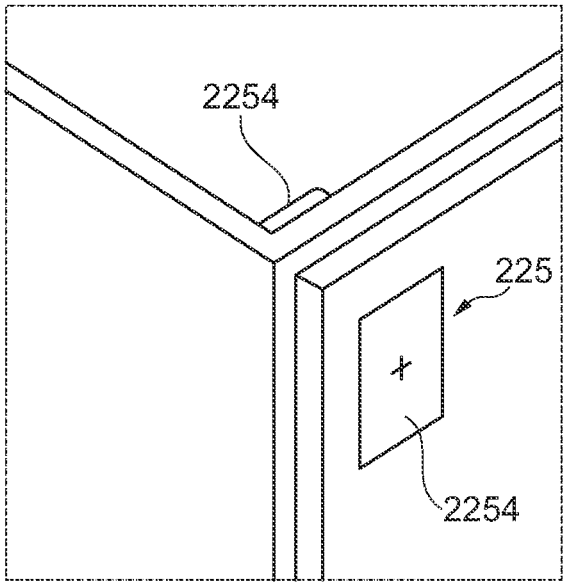
FIG. 15 is a perspective view of the means for blocking the case in a use position, according to a third embodiment.

FIG. 15 illustrates blocking means 225 by magnetism. For this purpose, each panel of the peripheral rim 22 is provided with a magnet 2254. In this case, the front panel 221 and the rear panel 222, or the side panels 223 have returns intended to overlap the side panels 223, or the front panel 221 and the rear panel 222 respectively.

The returns then each carry a magnet 2254 intended to cooperate with another magnet 2254 facing each other. To enable their cooperation, the magnets 2254 are mated in pairs with reversed polarity. In other words, the magnets 2254 of the side panels 223 have a negative polarity and the magnets 2254 of the front panel 221 and the rear panel 222 have a positive polarity, or vice versa.

Figure 16:
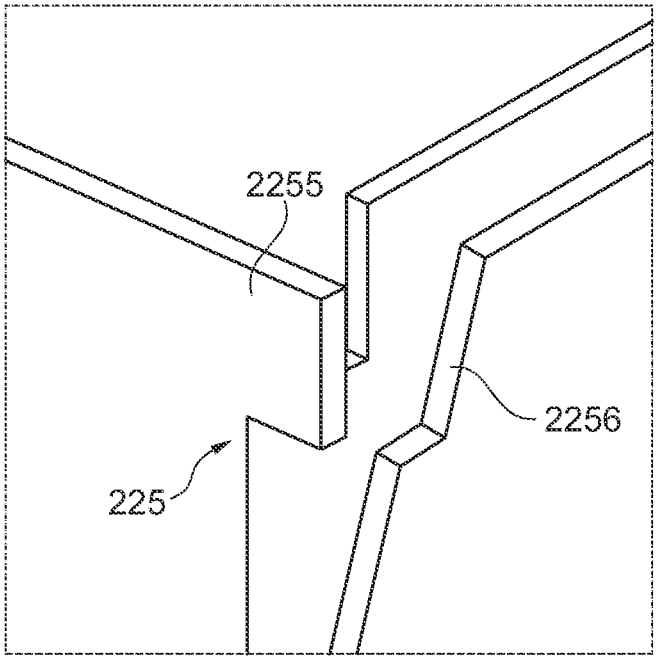
FIG. 16 is a perspective view of the means for blocking the case in a use position, according to a fourth embodiment.

FIG. 16 illustrates blocking means 225 by deformation. The side panels 223 then have a lug 2255 protruding from each rim oriented towards the front panel 221 and the rear panel 222.

The front panel 221 and the rear panel 222 then have recesses 2256 each intended to cooperate with a lug 2255. The insertion of a lug 2255 into a corresponding recess 2256 then causes the elastic deformation of the lug 2255 which, by seeking to recover its undeformed state, exerts a force on the recess 2256. This then causes the panels to be maintained in position with respect to each other, and therefore the peripheral rim 22 to be maintained in the use position.

According to a variant embodiment not shown, the rims of the panels of the peripheral rim 22 are replaced by the junction means 25. Thus, by blocking the junction means with one of the panels of the peripheral rim 22, the return of the peripheral edge 22 in its stowing position is prevented.

Advantageously, the case 2 comprises means 26 for locking the cover 3 on the case 2. More specifically, with reference to FIGS. 9 and 10, the locking means 26 comprise a first part 261 secured to the case 2 and a second part 262 secured to the cover 3.

When the cover 3 is in its closed position, the second part 262 of the locking means 26 of the cover 3 cooperates with the first part 261 of the locking means 26 of the case to allow locking the cover 3 in the closed position.

Figure 6:
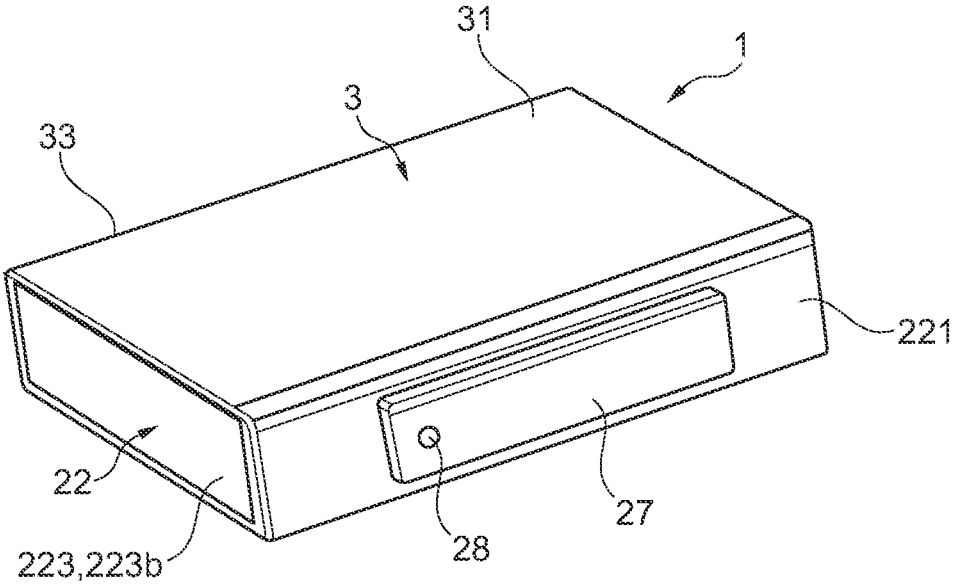
FIG. 6 is a perspective top view of a package according to the invention and according to a variant embodiment.

As illustrated in FIG. 6, the case 2 further comprises an electronic dialogue interface 27 allowing the user to interact with the package 1.

According to an advantageous aspect, the dialogue interface is connected on the one hand to the locking means 26 and on the other hand to a communication network to communicate with the latter. For this purpose, the electronic dialogue interface 27 comprises communication means (not shown) for exchanging with the communication network and more specifically with servers, as well as a communication device 28 allowing the user to interact with the package 1.

Preferably, the electronic dialogue interface 27 comprises a smart panel (not shown) intended to allow communication between the various elements, that is to say the electronic dialogue interface 27, the locking means 26 and the remote server.

The communication between the electronic dialogue interface 27 and the locking means 26 allows to control the locking means 26 and in particular to authorize the separation or to prevent access to the internal volume 23 of the case, that is to say the opening of the cover 3. Thus, this allows:

- to ensure that the cover 3 can adopt its open position only in particular locations or under particular conditions;
- to guarantee the safety of the object to be transported 5 inside the package 1.

According to a first embodiment illustrated in FIGS. 1, 4 and 5, each side panel 223 is mechanically connected to the front panel 221 and to the rear panel 222 by junction means 25.

The junction means 25 are flexible, in other words they can be deformed.

For example, the junction means 25 are in the shape of non-elastic straps which each have: a first portion 251 secured to the front panel 221 or to the rear panel 222;

- a second portion 252 secured to one of the side panels 223,
- a central portion 253 connecting the first portion 251 and the second portion 252.

The junction means 25 allow, as explained below, the shaping of the case, that is to say switching the peripheral rim from its stowing position to its use position, to be carried out by the only manipulation of the side panels 223.

In a stowing configuration (folded state or storage state of the package 1), as illustrated in FIG. 3, the package 1 is substantially flat. In other words, the peripheral rim 22 extends at least partially over the bottom 21 (the front panel 221 may be located in the extension of the bottom 21) and the cover 3 is folded over the peripheral rim 22.

In other words, the peripheral rim 22 is sandwiched at least partially between the bottom 21 and the cover 3.

To use the package 1, a user unfolds the cover 3 so as to position it substantially in the continuity of the bottom 21, as illustrated in FIG. 4, then shapes the case 2.

To shape the case 2, that is to say to position the peripheral rim 22 in its use position, the user only needs to exert a pulling force on the side panels 223 to the outside of the case 2. This has the effect of positioning the side panels 223 substantially perpendicular to the bottom 21 as well as the front panel 221 and the rear panel 222 thanks to the junction means 225. Indeed, the junction means 225 ensure a pulling of the front panel 221 and the rear panel 222 simultaneously with the pulling force exerted by the user.

The user then uses the blocking means to maintain the peripheral rim 22 in its use position.

In the use position of the peripheral rim 22, the cover 3 extends in the same plane as the rear panel 222.

When the case 2 is shaped, the front panel 221, the rear panel 222 and the side panels 223 are all positioned substantially perpendicular to the bottom 21 so as to form the internal volume 23 of the case 2.

Figure 9:
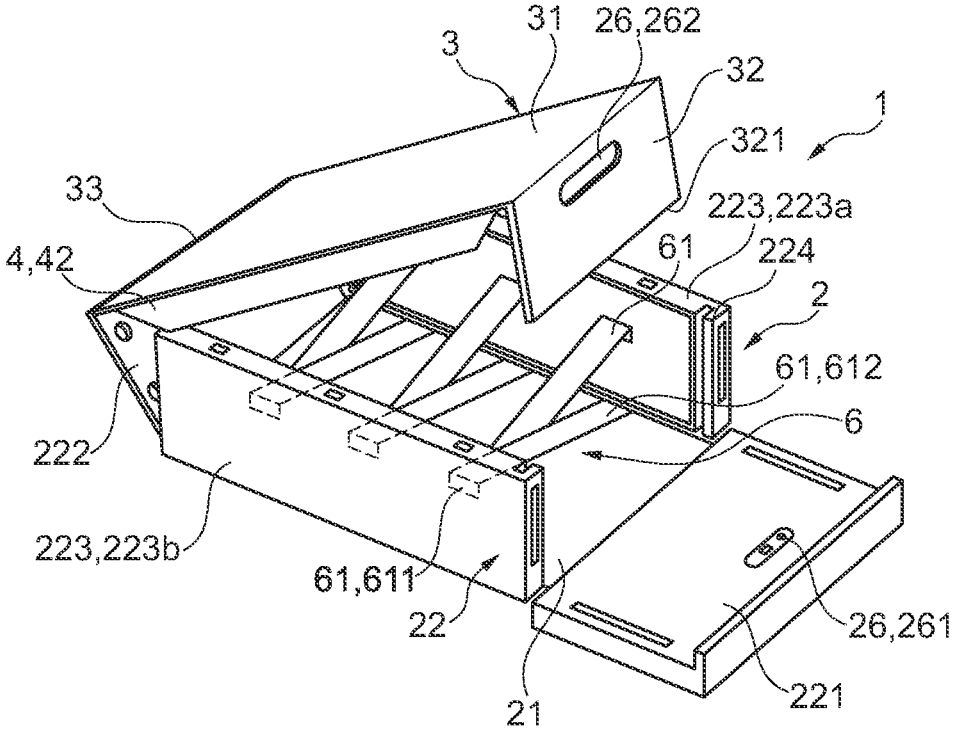
FIG. 9 is a perspective view of a package according to the invention, comprising holding means according to a second embodiment.

According to a second embodiment illustrated in FIG. 9, the junction means only mechanically connect the side panels 223 to the rear panel 222. The displacement of the two side panels 223 then causes the displacement of the rear panel 222. Likewise, when the rear panel 222 is displaced, it causes the displacement of the side panels 223 therewith.

To shape the case 2, that is to say to position the peripheral rim 22 in its use position, a user exerts a pulling force on the side panels 223 to the outside of the case 2. This has the effect of positioning the side panels 223 substantially perpendicular to the bottom 21 as well as the rear panel 222 thanks to the junction means 225. Indeed, the junction means 225 ensure a pulling of the rear panel 222 simultaneously with the pulling force exerted by the user. The user then positions the front panel 221 substantially perpendicular to the bottom 21 of the case 2 by exerting a pulling force to the outside of the case 2.

The user then uses the blocking means to maintain the peripheral rim 22 in its use position.

When the case 2 is shaped, the front panel 221, the rear panel 222 and the side panels 223 are all positioned substantially perpendicular to the bottom 21 so as to form the internal volume 23 of the case 2.

Figure 10:
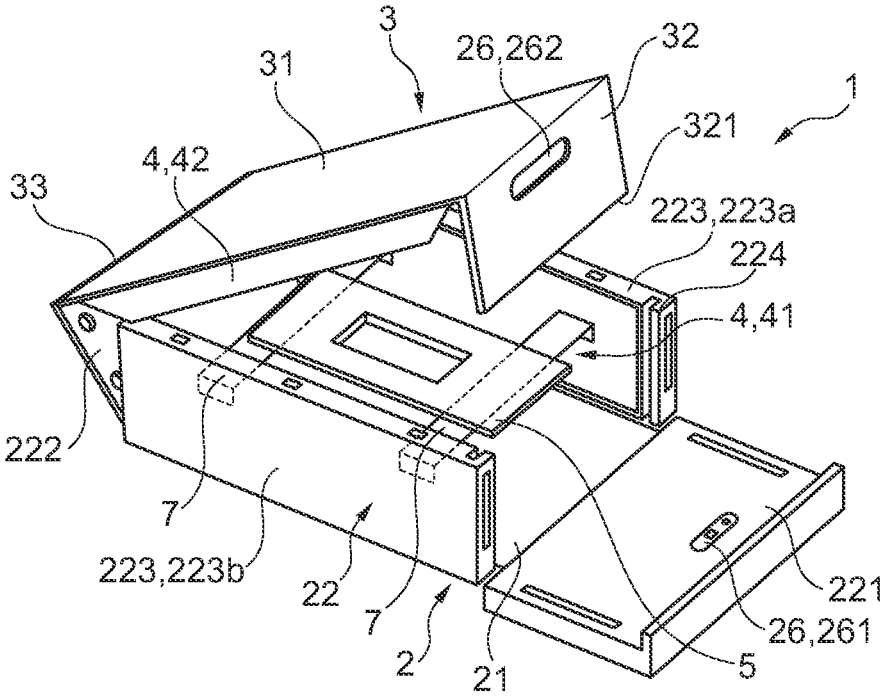
FIG. 10 is a perspective view of a package according to the invention, comprising holding means according to a third embodiment.

According to a third embodiment illustrated in FIG. 10, each of the front panel 221, the rear panel 222, the first side panel 223*a* and the second side panel 223*b* is independent of the other panels. In other words, the movement of the front panel 221, the rear panel 222, or one of the side panels 223 does not affect the movement of another panel of the peripheral rim 22.

To shape the case 2, that is to say to position the peripheral rim 22 in its use position, a user exerts a pulling force to the outside of the case 2 on each of the front panel 221, rear panel 222 and side panels 223.

When the case 2 is shaped, the front panel 221, the rear panel 222 and the side panels 223 are all positioned substantially perpendicular to the bottom 21 so as to form the internal volume 23 of the case 2.

The user then uses the blocking means to maintain the peripheral rim 22 in its use position.

With reference to FIGS. 1 and 6 in particular, the cover 3 is movable relative to the case 2 and can adopt at least:

- a closed position in which the cover 3 covers the peripheral rim 22, and therefore closes the access opening 24;
- an open position in which the cover 3 is spaced from the peripheral rim 22, and therefore from the access opening 24, so as to allow the insertion or removal of an object 5 to be transported in the internal volume 23 of the case 2.

More particularly, the cover 3 is rotatably mounted on the rear panel 222 of the case 2 by means of a hinge 33 taking in particular the shape of a fold.

The cover 3 comprises a plate 31 and a jamb 32 extending in the direction of the bottom 21 and having a free end 321 in the vicinity of the bottom 21 of the case 2 in the closed position of the cover 3.

More specifically, the jamb 32 is positioned at one end of the plate opposite the hinge, and forms an L in section with the plate 31.

According to a particular embodiment, the jamb 32 is movable relative to the plate 31 so as to be able to adjust the holding means 4 as explained below.

In the closed position of the cover 3, the jamb 32 is located in the internal volume 23 of the case 2. According to an advantageous embodiment illustrated in FIGS. 9 and 10 in particular, in the closed position of the cover 3, the jamb 32 is housed in grooves 224 made in the side panels 223. The jamb 32 is thus maintained in position which prevents the displacement of the plate 31 of the cover 3 from the first side panel 223*a* towards the second side panel 223*b* and vice versa. As is particularly visible in FIGS. 1, 5, 9 and 10, the cover 3 and the case 2 are integral or, in other words, form a single assembly.

According to a first embodiment, the resistance of the articulation between the rear panel 222 and the bottom of the case 21 is less than the resistance of the hinge 33 between the rear panel 222 and the cover 3.

This allows easy assembly and shaping of the package as described above. More specifically, this allows that, when shaping the case 2, the cover 3 remains parallel to the rear panel 222 without the users force. The advantage of this parallelism lies in the fact that the internal volume 23 of the case 2 is directly accessible as soon as the case 2 is shaped and that, consequently, the user does not have to manipulate the cover 3 to have access to the internal volume 23 in order to place an object 5 to be transported therein.

According to a second embodiment, the resistance of the articulation between the rear panel 222 and the bottom of the case 21 is greater than or equal to the resistance of the hinge 33 between the rear panel 222 and the cover 3.

This allows the cover 3 to adopt its closed position during the shaping of the case 2. Thus, to introduce the object to be transported 5 into the internal volume 23 of the case 2, it is necessary to manipulate the cover 3. This further ensures that the cover 3 adopts its closed position to ensure maintaining the object to be transported 5 in the case 2, even if no action is made on the cover 3.

The resistance of the articulation between the rear panel 222 and the bottom of the case 21, and the resistance of the hinge 33 between the rear panel 222 and the cover 3 can then be designed to allow the cover 3 to adopt either a normally closed position, or a normally open position by simply shaping the case 2.

Several embodiments of the holding means 4 are described below. Regardless of their specific features, the various embodiments of the holding means 4 have in common that they have a first part 41 secured to the case 2 and a second part 42 secured to the cover 3.

According to a first embodiment illustrated in FIGS. 1, 4 and 5, the first part 41 of the holding means 4 is formed by the bottom 21 of the case 2, and the second part 42 comprises a strap disposed in the shape of a cross.

The strap has:

- a central portion 43 intended to contact the object to be transported 5;
- a first end 44 by which the strap is connected to the bottom 21 of the case 2;
- a second end 45 by which the strap is connected to the cover 3 and more specifically to the jamb 32 of the cover 3.

The connection between the second end 45 of the holding means 4 and the jamb 32 is made at the free end 321 of the jamb 32, that is to say the end opposite to the connection between the jamb 32 and the cover 3 plate 31.

As can be seen in FIG. 4, the strap comprises four arms disposed crosswise. The arms are distributed in pairs, each pair forming the first end 44 or the second end 45, and are connected to the center of the strap by the central portion 43 which forms a connecting surface.

This central portion 43 is in a substantially square shape so as to provide a contact surface with the object to be transported 5 greater than the surface of each arm. The contact surface is intended to be opposite the cavity 211 of the bottom 21 in the closed position of the cover 3. Of course, the central portion 43 can adopt any other shape such as a rectangular, octagonal or else heptagonal shape, for example.

As illustrated in FIGS. 4 and 5 in particular, the first end 44 of the holding means 4 is located on the bottom 21 in the vicinity of the rear panel 222 and the second end is secured to the jamb 32.

The first end 44 and the second end 45 of the holding means 4 are distant from each other and define therebetween, on the bottom 21, an area for receiving the object to be transported 5 in the closed position of the cover 3.

Advantageously, the holding means are elastic at least at their first end 44 and at their second end 45.

More particularly, the first end 44 and the second end 45 each comprise an elastic member 46 interfacing between the holding means 4 and the case 2 or the cover 3.

Figure 2A:
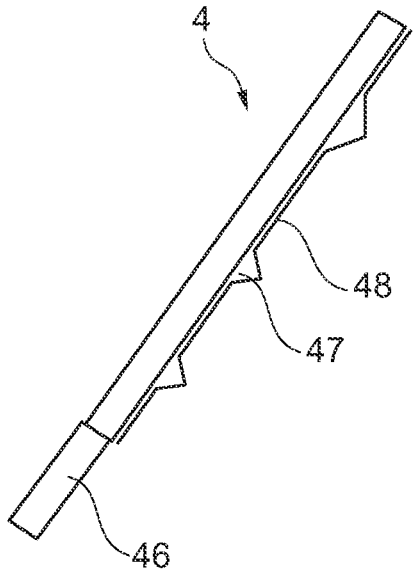
Figure 2B:
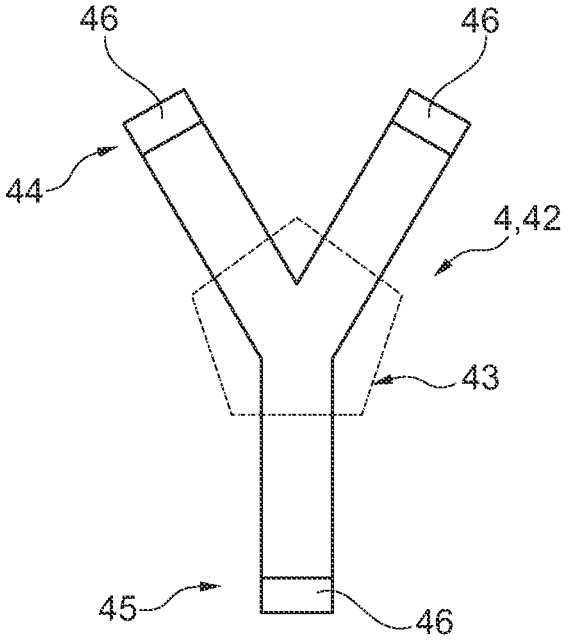

The elastic member 46, in particular illustrated in FIGS. 2*a* and 2*b*, may in particular be in the shape of a tension spring or of an elastically extensible material piece, for example. Each elastic member 46 allows at least partial deformation of the holding means 4 to adapt to the object to be transported 5.

Moreover, the strap has an inner face 47 turned towards the bottom 21 of the case 2 in the closed position of the cover 3. This inner face 47 carries an adherent coating 48 intended to adhere to the object to be transported 5 in the closed position of the cover 3.

The adherent coating can be formed by an additional coating attached to the strap, as illustrated in FIG. 2*a*, or by the strap itself.

In the case of an additional coating, the coating may comprise roughnesses and/or an adhesive material such as glue.

Of course, in the case where an adhesive material is used, the latter is selected so as to be compatible with the reusable nature of the package 1. That is to say that the adhesive material must adhere perfectly to the strap over time, capable of improving the retention of an object to be transported 5 under the strap, while having the ability to be separated from the object to be transported 5 when a user wishes to extract it from the package 1.

In the case of the material itself, it may in particular be a leather or a synthetic material which has features which allow it to be adhered to the objects to be transported 5 contained in the case 2.

Preferably, at least one of the first part 41 and of the second part 42 of the holding means has a sliding coating, the adherent coating 48 being located between two portions of the sliding coating.

According to a variant illustrated in FIG. 2*b*, the strap and the holding means have a Y shape, the base of the Y defining the first part 41 and the arms of the Y defining the second part 42 by which the holding means 4 are connected to the cover 3. The Y-shaped holding means comprise three elastic members 46 each located in the extension of one of the arms.

According to another variant not shown, the holding means comprise a film or a net instead of the strap.

The shaping of the case 2 ensures the tensioning of the holding means 4 which are then stretched between the bottom 21 of the case 2 and the jamb 32 of the cover 2. The switching of the cover 3 to its closed position then causes the application of the holding means 4 against the object to be transported 5 so as to maintain it in the internal volume 23 of the case 2, resting against the bottom 21, as illustrated in FIGS. 7 and 8.

Maintaining the object to be transported 5 against the bottom 21 of the case 2 is explained in particular by the fact that the holding means 4 are secured to the bottom 21 of the case and secured to the jamb 32. Thus, when the cover 3 is in its closed position, the object to be transported 5 is located between the first part 41 and the second part 42 of the holding means 4 and therefore between the bottom 21 of the case and the holding means 4.

The pressure exerted by the holding means 4 on the object to be transported 5, in particular thanks to the elastic members 46, allows to maintain the object to be transported 5 in position against the bottom 21 of the case 2.

Furthermore, the elastic members 46 allow adaptation of the holding means 4 to different sizes of objects to be transported 5.

For example, with reference to FIG. 8, a small object to be transported 5 is housed in the internal volume 23 of the case 2. More specifically, the object to be transported 5 is housed in the cavity 211 of the bottom 21 of the case 2 on the adherent surface of the cavity 211. The holding means 4 then extend against the bottom 21 of the case 2 so as to close the cavity 211 so that the object to be transported 5 is confined therein.

On the other hand, with a bulky object, as illustrated in FIG. 7, the elastic members 46 allow a deformation of the holding means 4 so as to match the object to be transported 5 and to maintain the latter between the bottom 21 of the case 2 and the holding means 4.

According to a second embodiment illustrated in FIG. 9, the first part 41 of the holding means 4 is secured to the bottom 21 and to the peripheral rim 22 of the case 2, and the second part 42 of the holding means 4 is in the form of a foam secured to a lower face 311 of the plate 31 of the cover 3.

More specifically, the first part 41 of the holding means 4 comprises a mesh 6 having a plurality of straps 61 adjacent to each other.

Each strap 61 is secured to one of the side panels 223 by a first end 611 and secured to the bottom 21 of the case by a second end 612 opposite to the first end 611.

As illustrated in FIG. 9, two adjacent straps 61 are disposed in a staggered manner. In other words, a first strap 61 is secured to the first side panel 223*a* by its first end 611 and a second adjacent strap is secured to the second side panel 223*b* by its first end 611.

This allows to create, on the mesh 6, a space for receiving the object to be transported 5 spaced from the bottom 21.

The straps 61 may include a part or be entirely made of an elastically deformable material. In the case where only part of the straps 61 is made of an elastically deformable material, the non-elastically deformable parts may comprise an adherent coating such as that mentioned above.

The foam of the second part 42 of the holding means 4 is a compressible foam intended to be opposite the receiving space formed by the mesh 6 in the closed position of the cover 3.

As explained below, the foam of the second part 42 of the holding means 4 is deformed by the object to be transformed 5 to at least partially match its contours and thus maintain it in position on the mesh 6.

The shaping of the case 2 ensures the tensioning of the first part 41 of the holding means 4, that is to say of the mesh 6. The straps 61 of the mesh are then stretched between the bottom 21 of the case 2 and the side panels 223 of the peripheral rim 22. The switching of the cover 3 to its closed position then causes the application of the second part 42 of the holding means 4 against the object to be transported 5 so as to maintain it in the internal volume 23 of the case 2 between the first part 41 and the second part 42 of the holding means 4.

According to a third embodiment illustrated in FIG. 10, the first part 41 of the holding means 4 is only secured to the peripheral rim 22 of the case 2, and the second part 42 of the holding means 4 is in the form of a foam secured to a lower face 311 of the plate 31 of the cover 3.

More specifically, the first part 41 of the holding means 4 comprises at least two strips 7.

Each strip 7 is secured to the first side panel 223*a* by a first end 71 and secured to the second side panel 223*b* by a second end 72 opposite to the first end 71.

As illustrated in FIG. 10, the first part 41 of the holding means 4 comprises two strips 7 spaced apart from each other and spaced from the bottom 21 of the case 2.

In other words, the two strips 7 form an empty space with the bottom 21 of the case 2 allowing the object to be transported 5 not to be in contact with the bottom 21 of the case 2.

The strips 7 may include a part or be entirely made of an elastically deformable material. In the case where only part of the strips 7 is made of an elastically deformable material, the non-elastically deformable parts may comprise an adherent coating such as that mentioned above.

The foam of the second part 42 of the holding means 4 is a compressible foam intended to be opposite the strips 7 in the closed position of the cover 3.

As explained below, the foam of the second part 42 of the holding means 4 is deformed by the object to be transported 5 to at least partially match its contours and thus maintain it in position on the strips 7.

The shaping of the case 2 ensures the tensioning of the first part 41 of the holding means 4, that is to say of the strips 7 between the side panels 223.

The switching of the cover 3 to its closed position then causes the application of the second part 42 of the holding means 4 against the object to be transported 5 so as to maintain it in the internal volume 23 of the case 2 between the first part 41 and the second part 42 of the holding means 4.

According to an embodiment not shown in the figures, the first part 41 of the holding means 4 comprises a net hammock and the second part 42 of the holding means 4 comprises a foam having an alternation of hollows and ridges, ridges being intended to be opposite the holes of the net in the closed position of the cover 3.

According to the third embodiment and the fourth embodiment, illustrated in FIGS. 9 and 10 respectively, the front panel 221 and the rear panel 222 extend between the side panels 223. Fixing the first part 41 of the holding means 4 on the side panels tends to exert a folding force of the side panels 223 towards the bottom 21 of the case. When the case 2 is shaped, that is to say that the peripheral edge 22 is in its use position, the folding force exerted by the holding means 4 on the side panels 223 is transmitted to the front panel 221 and the rear panel 222 by compressing them by the side panels 223.

This compression of the front panel 221 and of the rear panel 222 by the side panels 223 then prevents the folding of the front panel 221 and the rear panel 222 towards the bottom 21 of the case 2. The result is then that maintaining the peripheral edge 22 in its use position is ensured.

Figure 11:
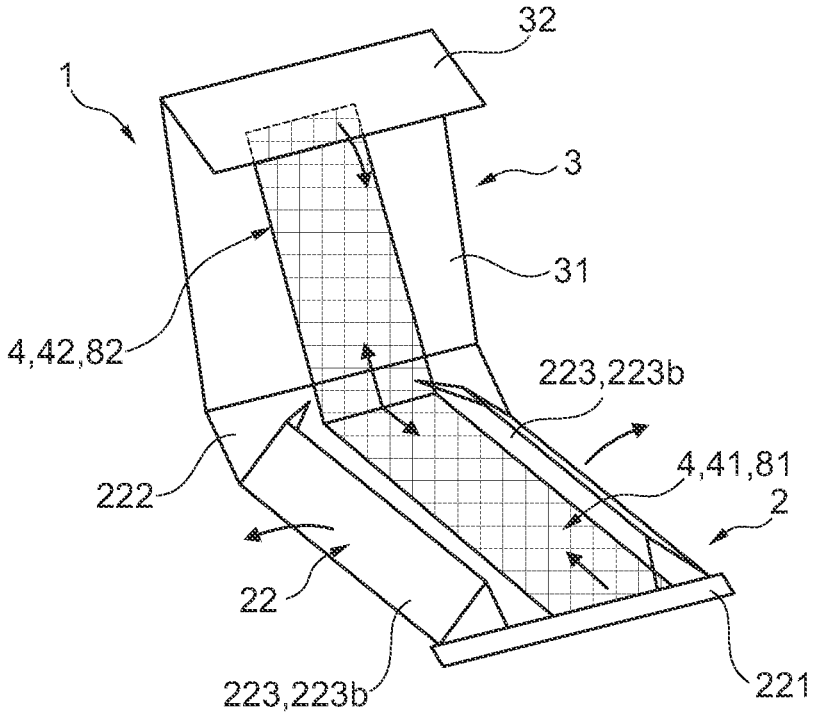
FIG. 11 is a perspective view of a package according to the invention, comprising holding means according to a fourth embodiment.
Figure 12:
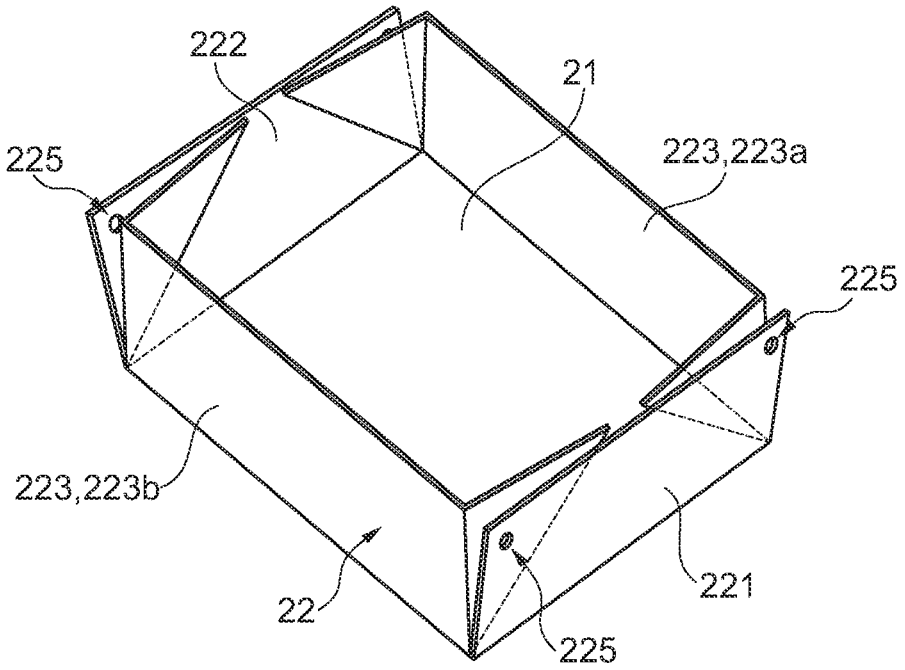
FIG. 12 is a perspective view of a case of a package according to the invention, comprising means for blocking the case in a use position.

According to a fourth embodiment illustrated in FIG. 11, the first part 41 of the holding means 4 is in the shape of a first hammock 81, for example of a net stretched between the side walls 223 or between the front wall 211 and the rear wall 22, at a distance from the bottom of the case 2, in the use position of the peripheral edge 22.

The second part 42 of the holding means 4 is also in the shape of a hammock in the shape of a second hammock extending between the rear wall 222 of the peripheral rim 22 and the jamb 32 of the cover 3.

The shaping of the case 2 ensures the tensioning of the first part 41 of the holding means 4, that is to say of the hammock between the side panels 223 or between the front wall 221 and the rear wall 222.

The switching of the cover 3 to its closed position then causes the application of the second part 42 of the holding means 4 against the object to be transported 5 so as to maintain it in the internal volume 23 of the case 2 between the first part 41 and the second part 42 of the holding means 4.

It is finally specified that the holding means 4, regardless of their shape, are designed to exert a low force on the object to be transported 5, so that maintaining the object to be transported 5 does not cause its degradation. Systems for adjusting the tension of the holding means 4 can be provided for this purpose.

Among the advantages of the package 1 according to the invention, mention may be made of the adaptability of the holding means 4 to different sizes of objects to be transported 5. As described above, both a small object to be transported 5 and a large object to be transported 5 can be maintained in the internal volume 23 of the case 2 by the holding means 4.

Mention may also be made of the compactness of the package 1, in particular in its stowing configuration (folded state or storage state). Indeed, the overlapping of the bottom 21 of the case 2 by the cover 3 allows to make the package 1 compact and space-saving when it is not in use.

This goes against the devices of the prior art which are either not foldable or have a large space requirement when not in use, even if their case is folded.

Furthermore, mention may be made of the ease of use since the simple shaping of the case 2 allows to make the holding means 4 usable. It is therefore not necessary to carry out additional handling operations other than shaping the case 2, as is the case for some of the devices of the prior art.

The invention claimed is:

1. A package comprising:

a case having a bottom and a peripheral rim which can adopt:

a stowing position in which the peripheral rim extends substantially parallel to the bottom;

a use position in which the peripheral rim extends from the bottom;

a cover movable relative to the case and able to adopt:

a closed position in which the cover covers the peripheral rim;

an open position, in which the cover is removed from the peripheral rim; and holding means for maintaining in the case an object to be transported, inserted into the case, wherein the case comprises means for blocking the peripheral rim in its use position, and wherein the holding means is deformable and comprises:

a first part secured to the case; and a second part secured to the cover, wherein at least one of the first part and the second part is relaxed in the stowing position of the peripheral rim, and tensioned in the use position of the peripheral rim.

2. The package according to claim 1, wherein the peripheral rim comprises:

a front panel;

a rear panel; and two side panels connecting the front panel and the rear panel, each panel being articulated to the bottom, the panels being substantially perpendicular to the bottom in the use position of the peripheral edge.

3. The package according to claim 2, wherein each side panel is connected to the front panel and to the rear panel by junction means, the displacement of the side panels when switching the peripheral edge from its stowing position to its use position, causing the displacement of the front panel and the rear panel.

4. The package according to claim 2, wherein the means for blocking the peripheral rim in its use position belong to the following group:

by magnetism;

by insert;

by deformation;

by bracing.

5. The package according to claim 1, wherein at least one of the first part and the second part of the holding means has at least one elastically deformable portion.

6. The package according to claim 1, wherein at least one of the first part and the second part of the holding means has an adherent coating.

7. The package according to claim 6, wherein at least one of the first part and the second part of the holding means has a sliding coating, the adherent coating being located between two portions of the sliding coating.

8. The package according to claim 7, wherein the adherent coating is centered relative to the bottom of the case in the closed position of the cover.

9. The package according to claim 1, wherein the first part and the second part of the holding means are distinct from each other, and wherein:

the first part is spaced from the bottom of the case in the use position of the peripheral edge; and the second part is in the form of a foam secured to a lower face of the cover turned towards the bottom of the case in the closed position of the cover.

10. The package according to claim 1, wherein:

the cover comprises a plate and a jamb extending in the direction of the bottom and having a free end in the vicinity of the bottom of the case in the closed position of the cover;

the first part of the holding means is formed by the bottom of the case; and the second part of the holding means is flexible and is secured to the bottom of the case or to the peripheral edge in the vicinity of the bottom of the case by a first end, and to the free end of the jamb by a second end, the first end and the second end of the holding means being distant from each other and delimiting therebetween, on the bottom, an area for receiving the object to be transported in the closed position of the cover.

11. The package according to claim 10, wherein the holding means comprise at least one strap.

12. The package according to claim 11, wherein the or each strap has an inner face turned towards the bottom of the case, the inner face having an adherent coating.

13. The package according to claim 11, wherein the or each strap has an X or Y shape, a first portion of the X or of the Y having the first end of the holding means and an opposite second portion having the second end of the holding means.

14. The package according to claim 10, wherein the holding means comprise a film intended to at least partially cover the bottom of the case in the closed position of the cover.

15. The package according to claim 10, wherein the jamb is pivotally mounted on the plate.

16. The package according to claim 10, wherein the bottom of the case has a cavity forming a housing for receiving the object to be transported.

17. The package according to claim 10, wherein the cavity has a base having an adherent surface intended to cooperate with the object to be transported in order to maintain it in position.

18. The package according to claim 16, wherein the cavity is centered on the bottom of the case.

19. The package according to claim 1, wherein the case comprises means for locking the cover in its closed position, the locking means including a first part secured to the case and a second part secured to the cover.

20. The package according to claim 1, wherein the case carries an electronic dialogue interface.

* * * * *